United States Patent [19]

Pinto et al.

[11] 4,157,163

[45] Jun. 5, 1979

[54] REVERSIBLE AIRLESS SPRAY NOZZLE

[75] Inventors: Joseph G. Pinto, Salisbury, Md.; Christopher Lawlor, North Ridgeville, Ohio

[73] Assignee: The Sherwin-Williams Company, Cleveland, Ohio

[21] Appl. No.: 850,757

[22] Filed: Nov. 11, 1977

[51] Int. Cl.[2] ..... B05B 15/02

[52] U.S. Cl. ..... 239/119; 137/270; 239/600; 285/12; 403/342

[58] Field of Search ..... 239/119, 526, 583, 600; 285/12; 118/302; 403/342, 261, 343; 137/269.5, 270, 270.5

[56] References Cited

U.S. PATENT DOCUMENTS

| | | | |
|---|---|---|---|
| 3,563,463 | 2/1971 | Walker | 239/119 |
| 4,074,857 | 2/1978 | Calder | 239/119 |

*Primary Examiner*—Robert B. Reeves
*Assistant Examiner*—Michael J. Forman
*Attorney, Agent, or Firm*—Richard G. Smith; James V. Tura

[57] ABSTRACT

An airless spray gun reversible spray nozzle unit is provided adapted to replace the normal or standard fixed spray position unit without any modification of the external spray head. The external spray head normally positions and holds the fixed position spray nozzle unit in spray position in the airless spray gun. The present adaptation is made possible by means of a floating or sliding female ferrule axially movably positioned and slideable intermediately between a pair of spaced apart keyed flanges defining the unit size which act as stops therefor and assures a leak-proof machined fit of the reversible nozzle when the inventive spray nozzle unit is positioned to spray, or in reversed position so the orifice of the nozzle can be backwashed and freed of binding occlusions.

The size, weight and form of the unit adds substantially no increase in weight or volume to the conventional fixed position airless spray head spray nozzle unit and is easily and quickly manually reversed when desired.

4 Claims, 8 Drawing Figures

REVERSIBLE AIRLESS SPRAY NOZZLE

This invention provides a reversible spray nozzle for insertion in airless spray gun heads of substantially the same mass and volume as prior art fixed spray nozzles.

It is understood that in presently available airless spray guns of commerce a number of modifications have been proposed to provide means for reversing the airless spray nozzle from the usual spray position to a cleaning position. Priorly this has been done with more or less complexity, cost and weight increase and some degree of cumbersome attachment. The reversibility concept is not a novel one.

O'Brien, U.S. Pat. No. 3,202,360; early recognized the advantages of reversibility and proposed external mechanical means for shifting between a spray position and a reversed or cleaning position using an external lever to accomplish this end. Watson, U.S. Pat. No. 3,593,920; encompassed the spray nozzle unit elements in a ball check valve arrangement which was reversed by an external lever turning the ball through 180° in the spray head for alternately painting and cleaning. Walker, U.S. Pat. No. 3,563,463; simplified the mechanical aspects of the art prior with an extension to be adapted forward of the standard spray head through use of a plurality of adapter elements including an extra set of threaded clamping members adding weight to the detriment of the gun balance and non-essential costs.

Hammelmann, U.S. Pat. No. 3,752,117 appears to disclose a similar plurality of adapters to the same end. Calder, U.S. Pat. No. 3,831,862; also recognized the problem but required a plurality of seals and adapters along with an external bolt-like control mechanism for lockably reversing the spray nozzle in oppositely oriented positions. The most recent art of which we are aware, Pyle et al, U.S. Pat. No. 3,955,763; also employs the ball valve of Watson containing the spray nozzle reversibly mounted therein.

Our objective is to provide a reversible spray nozzle devoid of removable seals, threaded parts and noticeable added weight which can replace a "one way" spray orifice at minimal cost and without leaking under the extreme pressures of airless spray use.

Obviously, a principal purpose of reversal of liquid flow through a spray nozzle is to remove any particles which tend to block and block proper operation of the spray nozzle orifice.

The principal advantage of the present invention over the known prior art is the use of a spray nozzle of substantially the same size, weight and essential shape as is standardly available in irreversible airless spray gun heads of commerce which can be substituted therefor without introduction of difficulty in attachment and use of nozzle guards or increase in exterior dimension or make any material change in the spray gun head of an airless spray gun unit.

The structure of this invention and the best mode known to the inventors will be made apparent in the detailed description below when read in conjunction with the drawings made a part thereof, wherein.

Figure 3:
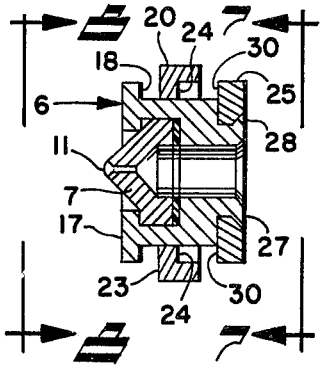
Figure 2:
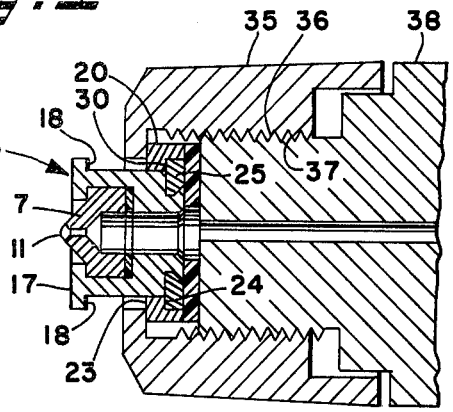
FIG. 2 is an enlarged vertical sectional view along the lines 2—2 of the spray gun head of FIG. 1 in spray position.

FIG. 3 discloses the inventive reversible spray gun nozzle unit in section removed from its operational locus as shown in FIG. 2.

Figure 4:
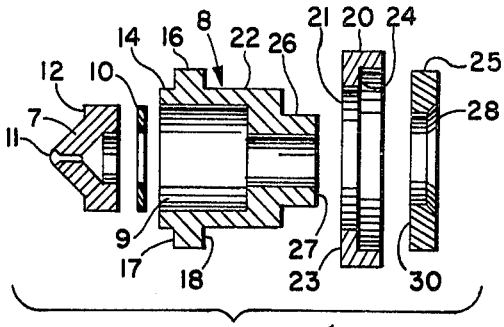

FIG. 4 is an enlarged, exploded sectional view of the parts shown in assembly in FIG. 3.

Figure 5:
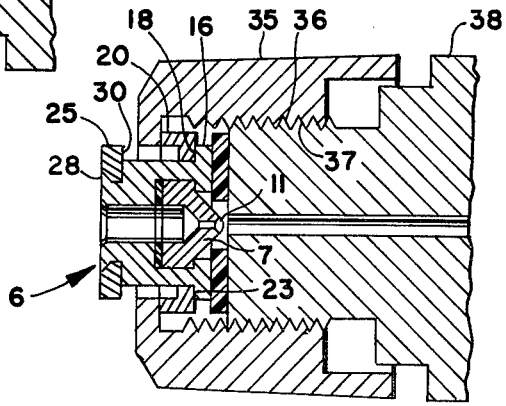

FIG. 5 is an enlarged sectional view showing the spray gun nozzle unit in reversed position for cleaning.

Figure 6:
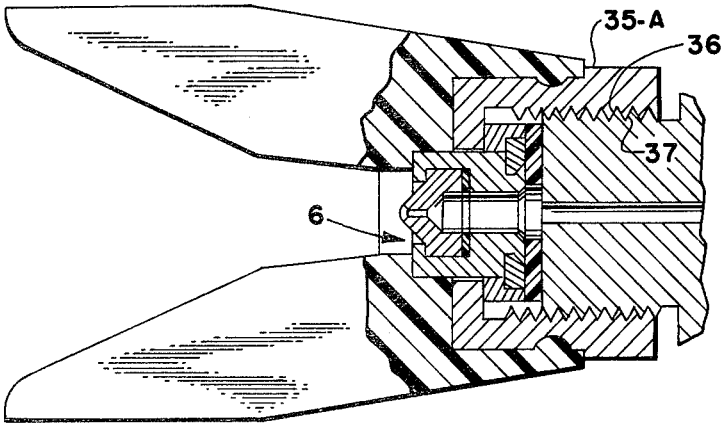

FIG. 6 illustrates a safety shield adapted to position and hold the spray gun nozzle unit assembly in spray position, partially in section.

Figure 7:
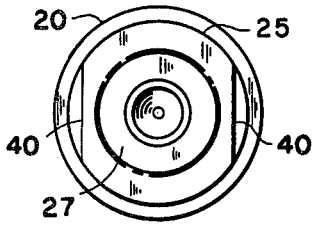

FIG. 7 is a rear view of the spray nozzle unit in assembly as seen along the line 7—7 of FIG. 3 (before sectioning).

Figure 8:
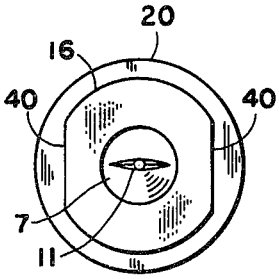

FIG. 8 is a front view of the spray nozzle unit in assembly as seen along the line 8—8 (before sectioning).

Figure 1:
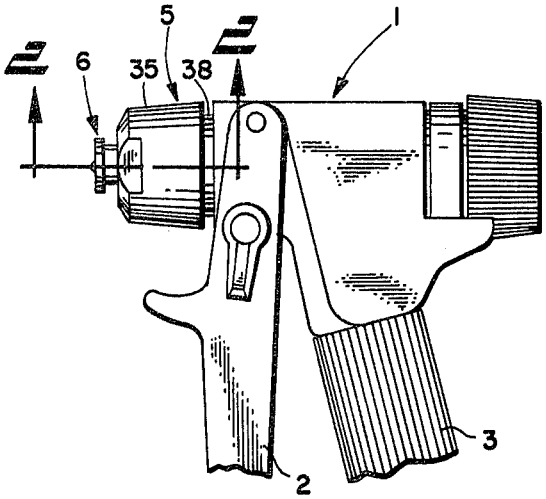
FIG. 1 is a generalized side view of an airless spray gun unit providing a locus of the invention element.

Referring in greater detail to the drawings, the airless spray gun body 1 represented in FIG. 1 illustrates broadly a trigger control 2 and handle grip 3 as are well understood elements containing standardly known and used essentials to transport liquid paint under extremely high pressures through valve control means (not shown) operable through trigger 2. The essential part of the airless spray gun to which novelty attaches is held in operable relation to the other parts of the airless spray gun through and within the removable spray head assembly 5. Extending axially outward from the front face of spray head 5 is the inventive spray head nozzle unit 6 through which the liquid coating compositions are atomized by means of the pressure differential between the ambient atmosphere and the paint supply when the control valve is opened through trigger 2. The liquid paint is then atomized by shear through the exterior slotted orifice 11 of the spray head nozzle. The spray head nozzle 6 is isolated in section in FIG. 3 and is shown more clearly in the enlarged, exploded view of FIG. 4 which details the structure of the spray head nozzle assembly.

Spray head nozzle 6 is assembled about the supportive axially bored body 8, carbide insert spray head orifice 7 being adapted to be slid into the larger bore 9 of body 8 seating against washer 10 when assembled in position in bore 9. To withstand the extremes of pressure developed within the bore 9 and the orifice 11, excess metal 14 at the entry to bore 9 is forced to flow inwardly about the forward face 12 of spray head orifice 7 by an orbital forming process permanently anchoring said orifice in its leak proof home position. The orbital forming process eliminates need for threads or pins, etc. In assembly, radially outwardly extending flange 16 is an integral part of body 8 and the vertical annular faces 17 and 18 thereof are machined for sealing engagement within the spray head 5 as will be apparent as the exposition is developed. The advance in the art is provided by means of a floating female ferrule 20 which is of L-shaped cross section and an exterior diameter larger than that of the forward flange 16. A forward face 23 said of ferrule 20 is cut rearwardly and axially through substantially half the ferrule thickness on a diameter sufficiently larger than the exterior body 8 diameter at 22 to allow floating or sliding ferrule 20 to slide freely back and forth over the exterior annular surface 22 of axially drilled boss 27 thereof stopping against face 18 of flange 16 in peripheral contact with face 23 of ferrule 20 in the most forward position. With ferrule 20 substantially in the position described, the rear keyed flange 25 centrally drilled and outwardly and annularly chamfered (as shown) 28 is axially brought home over the exterior circumference of drilled boss 27 section 26 of nozzle unit body 8. In this position, the chords 40 of flanges 16 and 25 are aligned and excess metal exterior to the flange 25 in its home position is outwardly stretched and swaged by the orbital spinning or forming process, expanding the excess metal rearwardly of boss 27 into the chamfer 28 to permanently fix and mount rear flange 25 in position as shown in FIG. 3. The spray head nozzle 6 is in final assembly as shown in FIG. 3, female ferrule 20 is freely slideable between the interior flange faces 18 and 30 of flanges 16 and 25, respectively.

When the spray nozzle 6 is in assembly and placed in the spray head as shown in FIG. 2 (for spray painting) ferrule 20 is moved rearwardly from the spray head orifice 7 and peripherally envelopes (in part) flange 25, the interior face 24 of ferrule 20 thereof being in peripheral contact with the interior face 30 of flange 25. The spray nozzle assembly is held in the operating position through the spray nozzle retainer ring 35 having internal threads 36 engaging external threads 37 of the front end of the barrel 38 of the airless spray gun. Use of the gun in its normal paint spraying mode is carried forward under the foregoing arrangement.

When the operator observes any defective changes in flow and flow rate of the spray discharge, retainer ring 35 is simply loosened and removed allowing the entire spray head nozzle assembly 6 to be removed, turned through 180°, and inserted into position in the spray head 5. Retainer ring 35 is replaced and tightened, pulling the peripheral face 23 of the female ferrule 20 against peripheral face 18 of keyed flange 16.

The flattened chords 40 (FIGS. 7 and 8) of flanges 16 and 25 provide keying with respect to the orifice 11 so that the nature of the spray of coating material produced is not altered by a change in the horizontal or vertical position of orifice 11 at 7. Upon discharging a small amount of coating in the position as shown in FIG. 5 any build up of foreign matter interiorly of the orifice 11 interfacing with flow is blown out of the assembly. After the cleaning procedure, the unit is reversed as in FIG. 2 and normal painting continued.

Comparison of the device herein described with the prior means suggested provides greater simplicity of construction without a plurality of additional threaded parts and without materially affecting the weight of the airless spray gun, nor affecting its exterior dimension. Replacement of seals are avoided and the security is not adversely affected because of less length of threaded engagement of the retainer ring 35 with the barrel 37 which takes place without the axially slideable female ferrule which provides automatic compensatory adjustment upon reversal of the spray nozzle assembly. In the modification of FIG. 6 one observes the adaptability of the invention to the use of a safety device to prevent the user from accidentally injecting paint into his body. It can be seen that merely replacing the standard retainer ring 35 with a safety shield as is commercially available no problems in adaptation to our use are experienced. Most devices heretofore described in the art fail to provide the desired flexibility of application as herein described.

What we claim is:

1. A spray gun nozzle unit assembly adapted to reversible longitudinal mounting within the confined space between the downstream end of an internally threaded retainer ring of an airless spray gun and the upstream externally threaded nozzle of a spray gun barrel which comprises:

(a) an axially bored cylindrical body member, the downstream paint dispersing end of which bore has permanently and centrally mounted in said bore an airless spray orifice;

(b) the opposite end of said axially bored body member terminating in a body section of reduced diameter in both the internal continuous bore and its external body diameter, said external end section adapted to accomodate a centrally bored flange element, which, in final assembly, is permanently positioned and held about said end section, the exterior face of said flange element in assembly being substantially flush with the exterior end body face;

(c) the spray orifice containing end of said body member likewise terminating in a radially outwardly extending annular boss of larger diameter than said body diameter, but of substantially the same external diameter as the said flange element, the vertical faces of said flange element and said boss being flat, separate from and parallel to each other and normal to the axis of said cylindrical body member;

(d) the internal flat faces of said annular boss at the spray orifice end and said internal flat face of said flange at the opposite end of said body member defining the length of the uniform external diameter cylindrical section and the limitation of axial displacement of a female ferrule when said ferrule is in medial position of its assembly on said body member to slide axially between the inwardly directed faces of said boss and said flange;

(e) the external diameter of said ferrule being larger than the diameter of said annular boss and said flange;

(f) axial movement of said ferrule or ring providing accomodation to permit sealable compression of the spray gun nozzle unit assembly, after assembly, within the described confined space as defined, in alternative positions of paint spraying or spray tip cleaning, into a hydraulic pressure tight engagement within the spray gun head space upon operative assembly of said unit elements.

2. The spray nozzle unit of claim 1 wherein said female ferrule is of L-shaped cross-section.

3. The spray nozzle unit of claim 2 wherein said L-shaped cross-section female ferrule is adapted to envelope at least in part said flange element.

4. An end keyed cylindrical spray nozzle universally adapted to reversible longitudinal attachment within the spray head of an airless spray gun permitting selective liquid spray application use or orifice cleaning use which comprises an axially bored body unit one end of which is adapted to receive a spray tip orifice which tip is permanently position therein, the opposite end of said axial bore terminating in a flange the overall length of said unit being substantially that of the standard spray nozzle to be replaced therewith, each end of said cylindrical body terminating in a radially outwardly extending peripherally keyed, generally cylindrical flange; and intermediate said terminal oppositely disposed flanges a female ferrule of larger exterior circumference than said end flanges, said ferrule adapted to slide along its axially centered position about the outer cylindrical body unit between said end flanges; said ferrule being of L-shaped cross-section and adapted to engage and envelope at least in part the end flange opposite said spray orifice.

* * * * *